United States Patent [19]

Bartlett

[11] 4,029,834

[45] June 14, 1977

[54] FLOOR MAT WITH HINGED RIGID ELONGATED RAILS

[75] Inventor: Gary F. Bartlett, Muncy, Pa.

[73] Assignee: Construction Specialties, Inc., Cranford, N.J.

[22] Filed: Dec. 22, 1975

[21] Appl. No.: 643,303

[52] U.S. Cl. ..... 428/62; 428/82; 428/83; 52/181; 52/593; 15/215

[51] Int. Cl.[2] ..... B32B 3/06; B32B 3/10; F04C 1/30; E04F 15/16

[58] Field of Search ..... 428/62, 81–82, 428/83; 15/215–216; 52/179, 181, 589, 593, 590–591

[56] References Cited

UNITED STATES PATENTS

| | | | |
|---|---|---|---|
| 2,202,636 | 5/1940 | McClelland | 52/181 |
| 2,680,698 | 6/1954 | Schnee | 52/591 X |
| 3,435,480 | 4/1969 | Mann, Jr. | 15/215 |
| 3,846,945 | 11/1974 | Roby | 52/591 X |
| 3,909,996 | 10/1975 | Ettlinger, Jr. et al. | 52/593 X |

*Primary Examiner*—Philip Dier
*Attorney, Agent, or Firm*—Brumbaugh, Graves, Donohue & Raymond

[57] ABSTRACT

A floor mat comprises substantially rigid, elongated rails disposed generally parallel to each other in closely spaced relation. Each rail has a base portion for supporting the mat and a top portion with a tread surface such as a strip of carpet, abrasive or vinyl thereon. Cooperative ball and socket structures along opposite sides of the rails fixedly space the rails from each other but permit rotational movement of the rails relative to each other whereby the floor mat may be rolled up or adjust itself to irregular floor surfaces.

9 Claims, 6 Drawing Figures

FLOOR MAT WITH HINGED RIGID ELONGATED RAILS

BACKGROUND OF THE INVENTION

This invention relates to floor mats of the type used, for example, in building entrances for removing dirt from the footwear of persons entering the building.

Almost all types of buildings, residential, commercial and industrial, commonly employ a grille, grating or mat either inside or outside (or both) of entrances to the building for removing dirt or water (or both) from the footwear of persons entering the building. A wide variety of such grilles, gratings and mats is available.

Grilles and gratings are often mounted over a substantial pit for accummulating or flushing away the material collected through the grille or grating. Mats, on the other hand, are usually placed on a floor or in a shallow well just deep enough for making the mat even with the adjacent floor. Inasmuch as there is thus less room beneath such mats for the accummulation of dirt or the like, it is particularly important for the mats as well as the surface beneath them to be easily cleanable.

One way of making cleaning easier is to make the mat easy to remove. The mat can then be carried to proper cleaning equipment and the surface which was beneath the mat can also be cleaned easily. Rolling mats, and particularly large mats, makes them easier to remove. It also makes them easier to install in confined spaces. The flexibility which permits rolling the mat also accommodates irregularities in the surface which supports the mat. A mat which can be rolled up is therefore particularly desirable.

Other attributes which a floor mat should have are effectiveness in dislodging and retaining dirt, snow and the like from footwear, attractiveness, and a durability which permits the mat to withstand abrasion and environmental conditions such as water, sunlight and temperature as well as salt and other substances which may be present in the matter collected by the mat. In addition to all these requirements, the mat must also be shallow in depth so as not to trip pedestrians and have a sufficiently smooth surface so as not to trap small high heels of a type from time to time fashionable on women's shoes.

SUMMARY OF THE INVENTION

There is provided, therefore, in accordance with the invention, a floor mat which very effectively meets the many requirements set forth above. The floor mat comprises substantially rigid, elongated rails disposed generally parallel to each other in closely spaced relation. Each rail has a base portion for supporting the mat and a top portion with a tread surface such as vinyl, abrasive, or a strip of carpet thereon.

The substantially rigid, for example metal, rails make the mat durable and permit its construction with a shallow elevation to reduce the tendency to trip people even when the mat is merely placed on a floor. The close spacing between the rails may be made sufficiently small to avoid trapping even the smallest heels customarily used on shoes but, at the same time, provides a space between the tread surfaces on the rails which increases the effectiveness with which the mat retains dirt and other matter cleaned from pedestrians' shoes. In a preferred embodiment, the space between the rails is formed with circular, oval or other suitably shaped slots or holes which can be punched, drilled or otherwise provided and which permit dirt to fall beneath the mat to still further improve the effectiveness with which the mat retains the collected matter.

Each rail has ball and socket structures along opposite, parallel sides of the rail. The ball of one rail interlocks with the socket of the adjacent rail for fixing the spacing of the rails from each other but permitting rotational movement of the rails relative to each other. Fixing the space between the rails assures that the rails will not shift under the action of pedestrian traffic to increase space between the rails enough to catch a heel. If, however, the rails were rigidly connected to each other, the mat would be difficult to remove for cleaning or install in confined areas. By permitting rotational movement between the interlocked balls and sockets, on the other hand, the mat can be easily rolled up for cleaning, for cleaning of the surface beneath the mat or for installing it in a confined space. Cleaning beneath the mat is, of course, particularly important in the embodiment which has slots or holes between the rails for collecting dirt beneath the mat. The flexibility from the ball and socket structure which permits rolling the mat also accommodates irregularity in the surface supporting the mat so that the mat lies flat.

Preferred embodiments of the mat further increase its desirability. In one preferred embodiment the bottom of the base portion of each rail receives a rib which runs continuously along the rail. The rib is made from a resilient material such as polyvinyl chloride to cushion the rails. The resilient ribs also help keep the mat from slipping along the floor as people walk across it. The resilient ribs also seal each rail to the supporting surface all along its length so that drafts which may accompany people through an entry cannot blow previously collected dirt from beneath the mat.

In another preferred embodiment, edge portions of the rails adjacent the tread surface extend part way across the space between the rails to further reduce the space between the rails. This still further reduces the space which could catch the heel of a shoe. The edge portions also provide a more even surface to the mat for easier walking.

In still another preferred embodiment, a first rail of the mat has sockets along both sides, one socket receiving the tongue of the next rail and the other socket receiving a tongue on an entry frame for the mat. The entry frame may have a flat surface when the mat is recessed to the height of the floor or an inclined surface when the mat is placed on a floor. By providing a groove on both sides of the first rail of the mat, the same type of entry frame (having a ball received in a socket of a rail of the mat) may be used at both ends of the mat to thereby save the necessity for two different types of entry frames.

The tread surface of the mat may be made of various materials including the material of the rails themselves (e.g. metal or plastic), a grit for improved footwear cleaning and traction, a cushioning resilient material such as plastic, or a pile fabric such as carpet. In general, a removable carpet strip is preferred inasmuch as carpet is an excellent dirt remover, esthetically pleasing, and reasonably durable.

One form of removable carpet strip and companion rail tread surface construction is described in U.S. Pat. No. 3,783,471 which issued Jan. 8, 1974 and is assigned to the assignee of the present application. This form of tread surface is preferred for the significant advantages of installation and use described in the patent.

The effectiveness with which even a carpet-surfaced mat works is further enhanced by the dirt capturing or storing ability of the mat itself. The mat disclosed herein captures dirt in the spaces between the rails even though these spaces may be bridged all along the length of the rails by part of the ball structures which project into the sockets of the adjacent rails. Although the ball structures could be segmented, continuous structures are preferred for increasing the strength of the mat. Slots or holes through the ball structures provide further dirt capturing ability because some of the dirt captured between the rails passes through the slots or holes to the space beneath the mat.

The rotational flexibility of the ball and socket structure is of particular advantage when the mat has slots or holes between the rails. By rolling the mat away from its usual position on the floor, the space beneath the mat can be quickly and conveniently cleaned. The mat can also be rolled away for storage when not required as well as more easily moved to a cleaning station where, for example, it could be hosed down.

When constructed of appropriate materials such as extruded aluminum rails and highly durable carpet materials, the mat has a very long useful life. Moreover, the use of replacable carpet strips in the mat further enhances its useful life. Replacement of the carpet strips restores the mat to a new appearance.

The construction of the mat further lends itself to manufacture at a low cost. Only a single shape which may be easily made by extruding aluminum is required and only one other first rail and lead-in frame parts are required for the preferred embodiment. Such parts are well adapted for mass production.

DESCRIPTION OF THE DRAWINGS

Preferred embodiments which are intended to illustrate but not to limit the invention will now be described with reference to drawings in which.

DESCRIPTION OF THE PREFERRED EMBODIMENT

Figure 1:
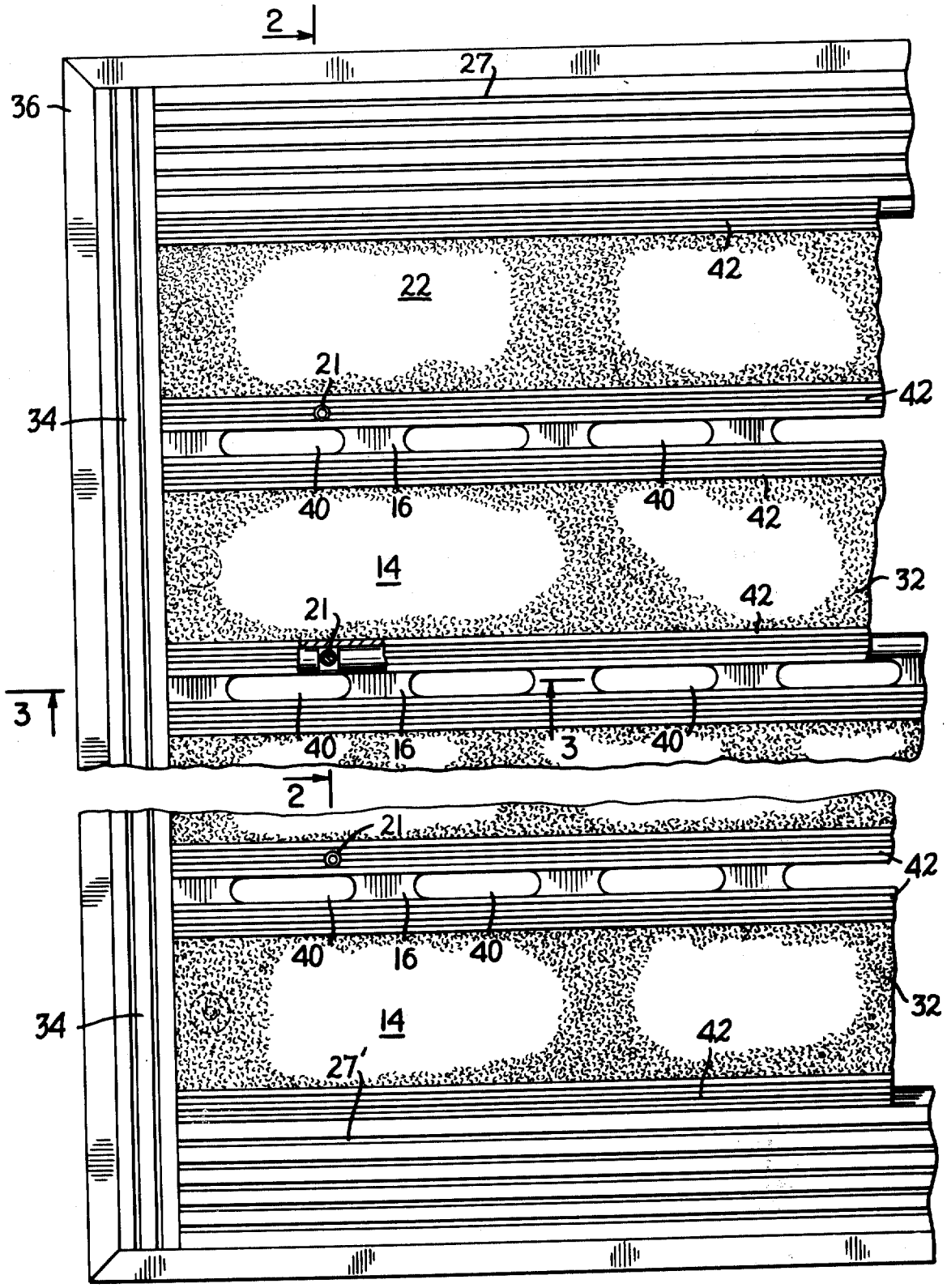
FIG. 1 is a top view of part of one preferred embodiment of the invention.
Figure 2:
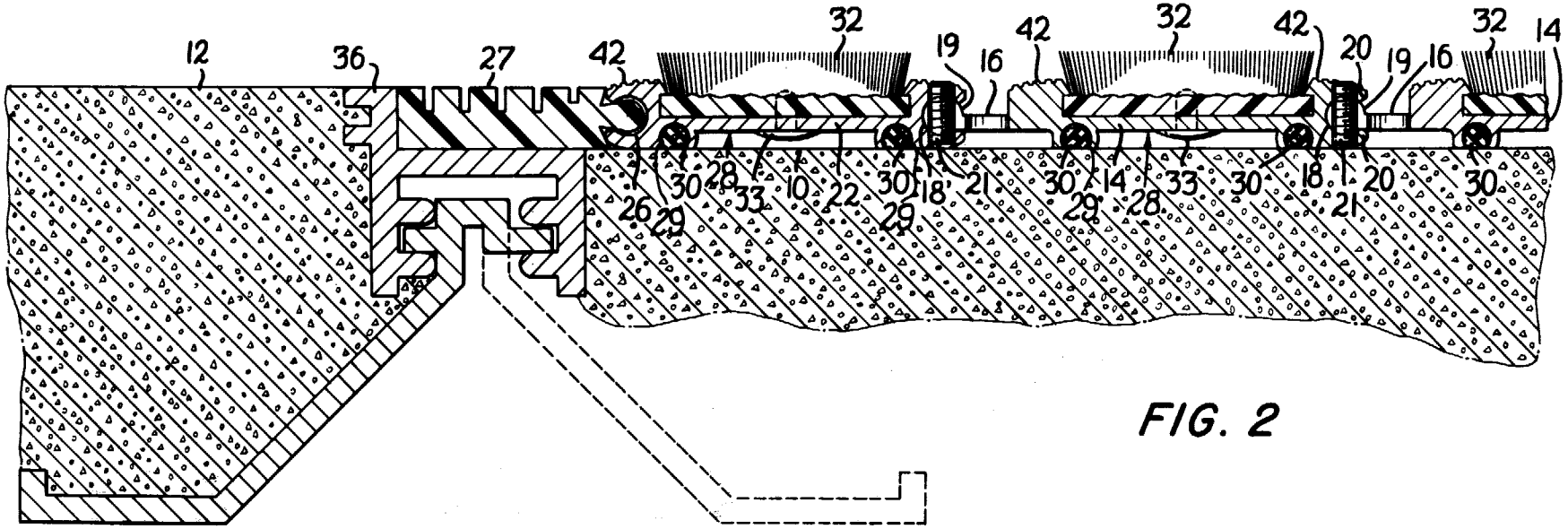
FIG. 2 is an elevation, partly in section, of one end of the embodiment shown in FIG. 1.
Figure 3:
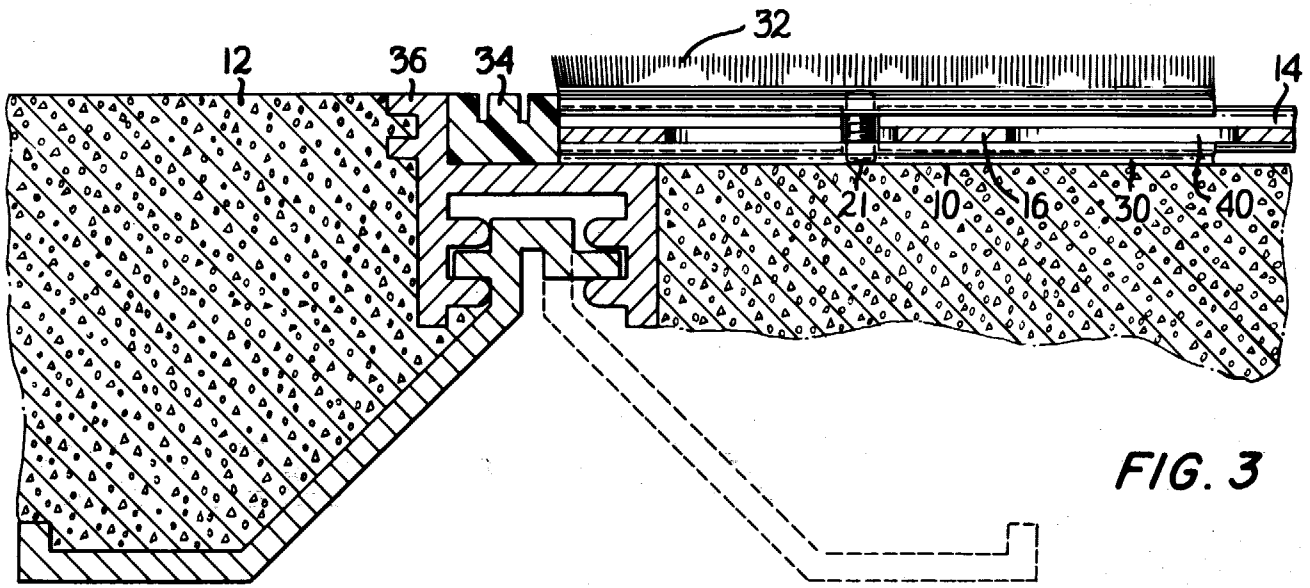
FIG. 3 is an elevation, partly in section, of one side of the embodiment shown in FIG. 1.

The preferred embodiment of the mat shown in FIGS. 1 to 3 is mounted in a recessed portion 10 of a floor 12 to make the surface of the mat substantially level with the adjacent surface of the floor. The mat comprises elongated rails 14 which are parallel to each other and closely spaced from each other. A ball structure 16 extends from each rail to a socket 18 in an adjacent rail for interlocking the rails with each other but permitting the rails to be rotated relative to each other transverse to their length so that the mat can be rolled up.

For this purpose, the ball structures have an enlarged ball end 19 which corresponds with a partially enclosing configuration of the socket 18 for interlocking the balls and sockets to prevent their separation. Edges 20 of the sockets are appropriately cut-away at the entrance to the sockets to facilitate limited rotation of the balls in the sockets without destroying the interlocking of the balls and sockets which prevents their separation. Fasteners 21 extend through the sockets at spaces between adjacent portions of the balls or at the ends thereof (not shown) to keep the rails for shifting lengthwise of the sockets but still permitting them to rotate in the sockets.

A first rail 22 of the mat differs from the other rails only in having a socket 18', 26 along both sides. Socket 18' receives the ball 16 of the adjacent one of the rails 14 as before described. The other socket 26 receives a ball which extends from a resilient lend-in member 27.

The entry or lead-in member is configured and dimensioned for making the entry part of the mat flush with the adjacent surface of the floor 12. An identical member 27' is used at the other end of the mat with its ball in the socket 18 of the last rail so that the whole mat is interlocked.

The complete mat may, of course, include additional, similar rails 14 (not shown) to provide the desired length to the mat. The width of the mat is selected by merely cutting each of the rails 14, 22 to an uniform length.

Each rail 14, 22 has a base part 28 for supporting the rails on the surface of the recessed floor portion 10. The bottom of the base portion of each rail has a pair of channels 29 which extend along the length of the rail and each receive a rib 30 of a resilient material such as polyvinyl chloride or neoprene. The ribs project slightly below the base portion of the rails to provide cushioned support for the rails. The ribs further seal each rail to the recessed surface along the entire length of the rail so that dirt cannot be blown easily from beneath the mat and resist slipping or shifting of the rails and thus the mat along the floor.

Each rail 14, 22 also has a top portion with a tread surface 32 thereon. In this embodiment, the tread surface is a strip of carpet which extends along the length of each rail (width of the mat) and is secured to the rail as, for example, disclosed in the above-identified U.S. patent. Fasteners 33 further extend from the base portion of each rail into a base part of the carpet strips to hold the strips in place.

An edge member 34 extends along each side of the mat. The edge members 34 may be separately positioned in the recessed portion 10 of the floor or connected to the rails with tabs extending to fasteners (not shown) on the rails. The edge members further help to hold the mat in place.

The recessed portion 10 of the floor 12 is defined by anchor members 36. The anchor members are securely fastened to the floor as by being cast in situ therein and have an L-shaped top surface for defining the recessed portion 10 which receives the mat. The anchor members 36, and lead-in members 27, 34 also cooperate with the ribs 30 and the rail-spacing ball and socket interlock between the rails to prevent the mat from shifting on the floor.

A plurality of slots 40 are defined in the ball structures 16. The slots permit dirt and other material which is collected by the mat to fall between the rails to further enhance the dirt-retaining ability of the mat. When, however, the mat is provided with the additional dirt-retaining capability of the slots 40, it is particularly desirable to be able to roll up the mat to clean underneath it. Rolling the mat is made possible by the rotational movement of the rails permitted by the interlocking balls and sockets.

Each rail member 14, 22 has edge portions 42 along each side. The edge portions extend part way over the space between the rails for further reducing the space between adjacent rails. A top surface of the edge portions is also proximate the tread surface to further provide a smoother surface across the mat. Reducing the space between the rails reduces the possibility of catching the heel of a shoe between the rails while providing a smoother surface makes the mat easier to walk across. The top surface of the edge portions 42 may also be ribbed as shown to further enhance the ability of the mat to clean dirt from pedestrians' feet.

Another Preferred Embodiment

Figure 4:
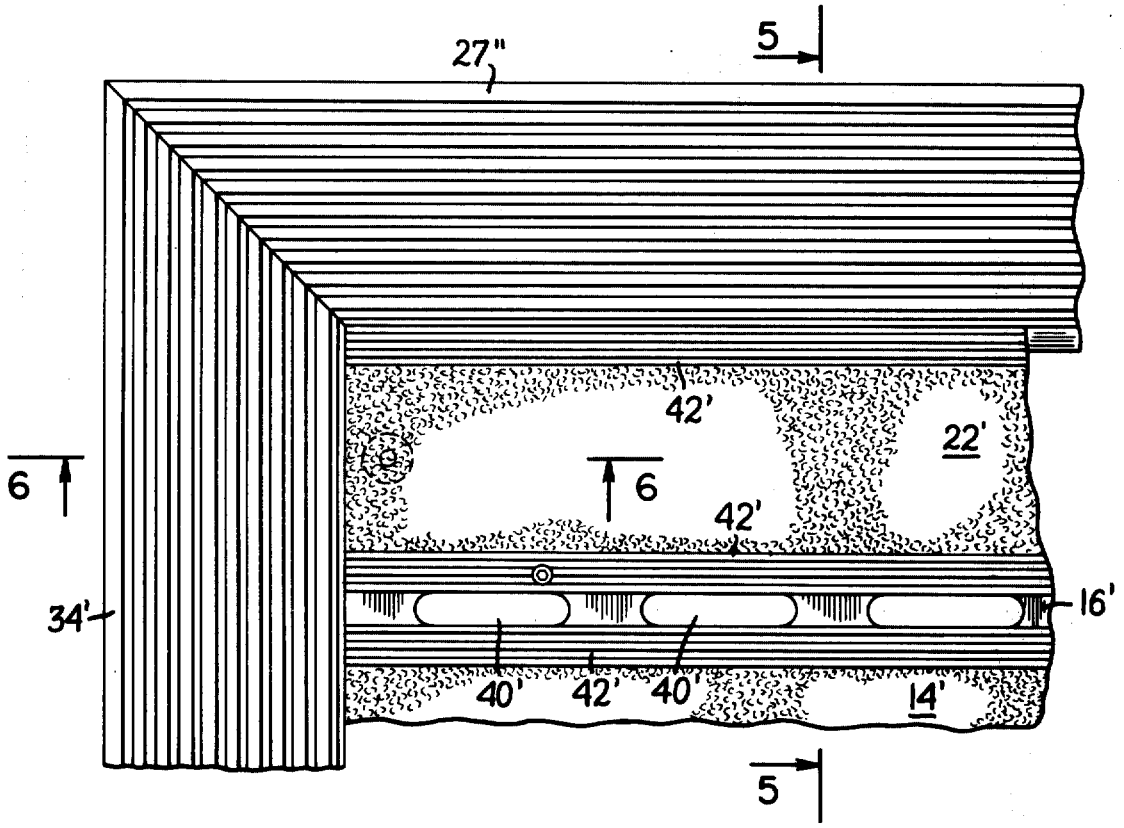
FIG. 4 is a top view of part of another preferred embodiment of the invention.
Figure 5:
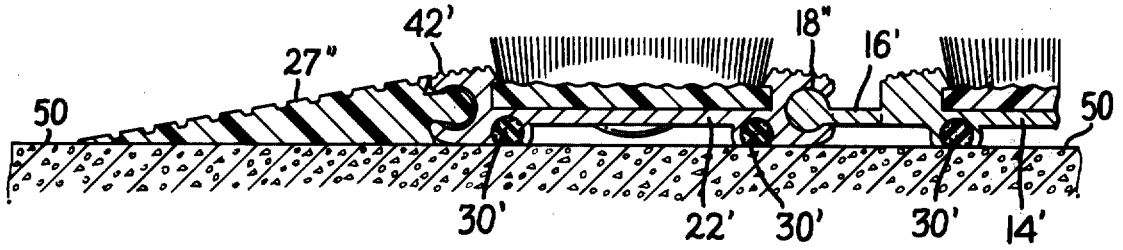
FIG. 5 is an elevation, partly in section, of one end of the embodiment shown in FIG. 4.
Figure 6:
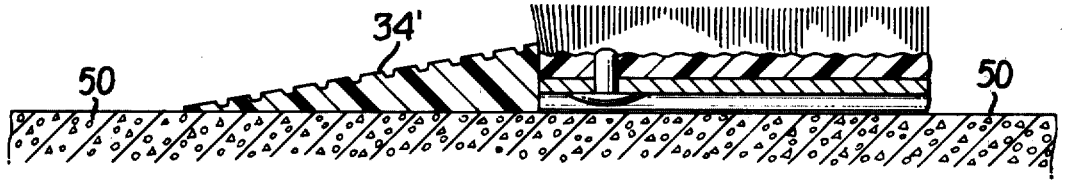
FIG. 6 is an elevation, partly in section, of one side of the embodiment shown in FIG. 4.

FIGS. 4 to 6 show another preferred embodiment which is structurally similar to the embodiment just described with reference to FIGS. 1 to 3 but is differently installed for use. The embodiment shown in FIGS. 4 to 6 is mounted on a flat portion (without recess) of a floor 50.

The lead-in members 27'', 27''' (not shown), and 34' differ from the lead-in member 27, 27' and 34 (FIGS. 1 to 3) by tapering from the surface of the floor 50 to the level of the edge portions 42' of the rails. These lead-in members may be secured to the floor with fasteners (not shown) to again cooperate with the interlocking ball and socket structures between the rails and the ribs 30' supporting the rails to keep the mat from shifting on the floor as it is walked across. It may also be found, however, that the ribs 30' alone are sufficient to keep the mat from shifting.

The embodiment shown in FIGS. 4 to 6 demonstrates another important advantage of the mat. Making the rails substantially rigid the mat may have a relatively short elevation so as not to present a significant obstacle to pedestrian traffic across the mat or access doors even when the mat is merely placed on a flat floor. The rails, of course, continue to provide the good dirt retention capability to the mat by trapping dirt in the space between the rails as well as on the tread surface and, when there are slots 40' or holes in the ball structures, in the space beneath the mat.

I claim:

1. A floor mat comprising a multiplicity of substantially rigid, elongated rails disposed generally parallel to each other in closely spaced relation, each rail having a base portion for support, a top portion, a ball structure extending continuously along one edge and having an enlarged ball end portion of uniform arcuate cross-section, and a socket structure extending continuously along the other edge and having an enlarged socket end portion defining an outwardly open concavity of arcuate cross-section matching the ball portion, the rails being interlocked with each other for fixedly spacing them from each other by reception of a ball portion of one rail within a socket portion of an adjacent rail, and the opening to the concavity being smaller than the ball end portion but larger than the part of the ball structure adjacent the ball end portion and at the opening to permit rotational movement of the rails transversely relative to each other, whereby the floor mat may be rolled up, and a tread surface on the top portion.

2. A floor mat as set forth in claim 1 wherein the tread surface is a strip of carpet extending along each rail.

3. A floor mat as set forth in claim 1 and additionally comprising at least one channel extending along the bottom of the base portion of each rail and a rib of a resilient material projecting from the channel for providing cushioned support for each rail, sealing each rail to a surface on which the mat is placed along the length of the rail, and resisting shifting of the mat as it is walked across.

4. A floor mat as set forth in claim 1 wherein the ball structure of each rail has spaced openings therein located inwardly from the ball end portion for permitting dirt to fall beneath the mat.

5. A floor mat as set forth in claim 1 wherein each rail member additionally comprises an edge portion having a top surface proximate the tread surface and extending part way over the space between adjacent rails for providing a smoother surface to the mat.

6. A floor mat as set forth in claim 1 and additionally comprising at least one fastener extending through each socket structure adjacent portions of the ball structure in the socket structure for keeping the ball structures from shifting lengthwise in the socket structures.

7. A floor mat as set forth in claim 1 and additionally comprising a first rail having a base portion for support, a top portion, socket structures along both sides, one socket structure for receiving a ball structure of an adjacent rail and the other socket structure for receiving a ball structure of a lead-in member, the lead-in member having the ball structure connected to the first rail along one end of the mat, and a tread surface on the first as well as each other rail of the mat.

8. A floor mat as set forth in claim 7 further comprising an identical lead-in member at the other end of the mat having a ball structure connected to the socket structure of the last rail of the mat.

9. A floor mat as set forth in claim 7 wherein each rail has an edge portion along each side with a top surface proximate the tread surface, the floor mat being on a flat floor surface and the lead-in member tapering from the flat floor surface to the top surface of the edge portion adjacent the lead-in member.

* * * * *